US006299470B1

(12) United States Patent
Lin et al.

(10) Patent No.: US 6,299,470 B1
(45) Date of Patent: Oct. 9, 2001

(54) CONTACT FOR A ZIF PGA SOCKET

(75) Inventors: Nick Lin, Hsin-Chuang; Bono Liao, Taichung, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/751,556

(22) Filed: Dec. 29, 2000

(51) Int. Cl.[7] ..... H01R 4/50
(52) U.S. Cl. ..... 439/342; 439/259
(58) Field of Search ..... 439/259, 342, 439/862

(56) References Cited

U.S. PATENT DOCUMENTS 6,086,401 * 7/2000 Hsiung et al. ..... 439/342

* cited by examiner

*Primary Examiner*—Tho D. Ta
(74) *Attorney, Agent, or Firm*—Wei Te Chung

(57) ABSTRACT

A contact (10) for a ZIF PGA socket (20) includes a horizontal single-beam contact portion (12) and an elongated mounting portion (11) depending from the contact portion. The mounting portion includes a fixing portion (16) for fixing to the socket, a leg (19) depending from the fixing portion for extending through the socket and electrically communicating with a circuit board, and a neck (14) integrally connecting the contact portion and the fixing portion. The neck is substantially narrower than the fixing portion and the contact portion, thus allowing the contact portion to twist about a central vertical axis of the contact and to be displaced relative to the fixing portion. The contact portion can thereby rotatably contact and resiliently press against a corresponding pin (30) of a mating PGA device.

6 Claims, 6 Drawing Sheets

CONTACT FOR A ZIF PGA SOCKET

BACKGROUND OF THE INVENTION

1. Field of the Invention

The invention generally relates to a contact for use in a zero insertion force (ZIF) pin grid array (PGA) socket, and particularly to a contact which provides maximized ZIF space and enhanced normal force for a complementary pin of a PGA device.

2. Related Art

Sockets are generally mounted on circuit boards for reception of electronic devices therein. The electronic devices electrically communicate with circuit traces on the circuit board via the sockets. During initial insertion of a pin grid array (PGA) device into a PGA socket, zero insertion force (ZIF) is desired to minimize the risk of damage to the device or the socket.

Contacts of a ZIF PGA socket are generally of two kinds. One kind has a double-beam structure, as disclosed in U.S. Pat. Nos. 5,213,530 and 5,123,855. That is, a pin of a PGA device is sandwiched between double beams of a corresponding contact of a socket, for establishing electrical and mechanical engagement therebetween. The other kind has a single-beam structure, as disclosed in U.S. Pat. Nos. 5,052,101 and 5,489,218. That is, a pin of a PGA device is sandwiched between a single beam of a corresponding contact of a socket and a sidewall of the socket, for establishing electrical and mechanical engagement therebetween.

A single-beam contact generally occupies less space within a socket than a comparable double-beam contact. Thus a single-beam contact can provide increased density of contacts within a socket. When more contacts can be provided within a given space, improved high speed and high frequency signal transmission can be attained.

However, conventional single-beam contacts do not have enough elasticity to reliably maintain connection with pins of PGA devices after prolonged periods of use.

An improved contact for a ZIF PGA socket is desired to overcome the above-mentioned problems.

SUMMARY OF THE INVENTION

A main object of the present invention is to provide a ZIF PGA socket contact which applies sufficient normal force to a complementary pin of a PGA device for maintaining reliable connection therebetween.

Another object of the present invention is to provide a contact occupying minimal space within a ZIF PGA socket, thus allowing free insertion of the complementary pin therein.

A contact in accordance with the present invention for a ZIF PGA socket includes a horizontal single-beam contact portion and an elongated mounting portion depending from a middle of the contact portion. The mounting portion includes a fixing portion for fixing the contact to the socket, a leg depending from an end of the fixing portion for extending through the socket and electrically communicating with a circuit board, and a neck integrally connecting the contact portion and the fixing portion. The neck is substantially narrower than the fixing portion and the contact portion, thus allowing the contact portion to twist about a central vertical axis of the contact and to be displaced relative to the fixing portion. The contact portion can thereby rotatably contact and resiliently press against a corresponding pin of a mating PGA device.

Other objects, advantages and novel features of the present invention will be drawn from the following detailed description of the preferred embodiment of the present invention with reference to the attached drawings, in which:

DETAILED DESCRIPTION OF THE INVENTION

References will now be made in detail to a preferred embodiment of the present invention. While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Figure 1:
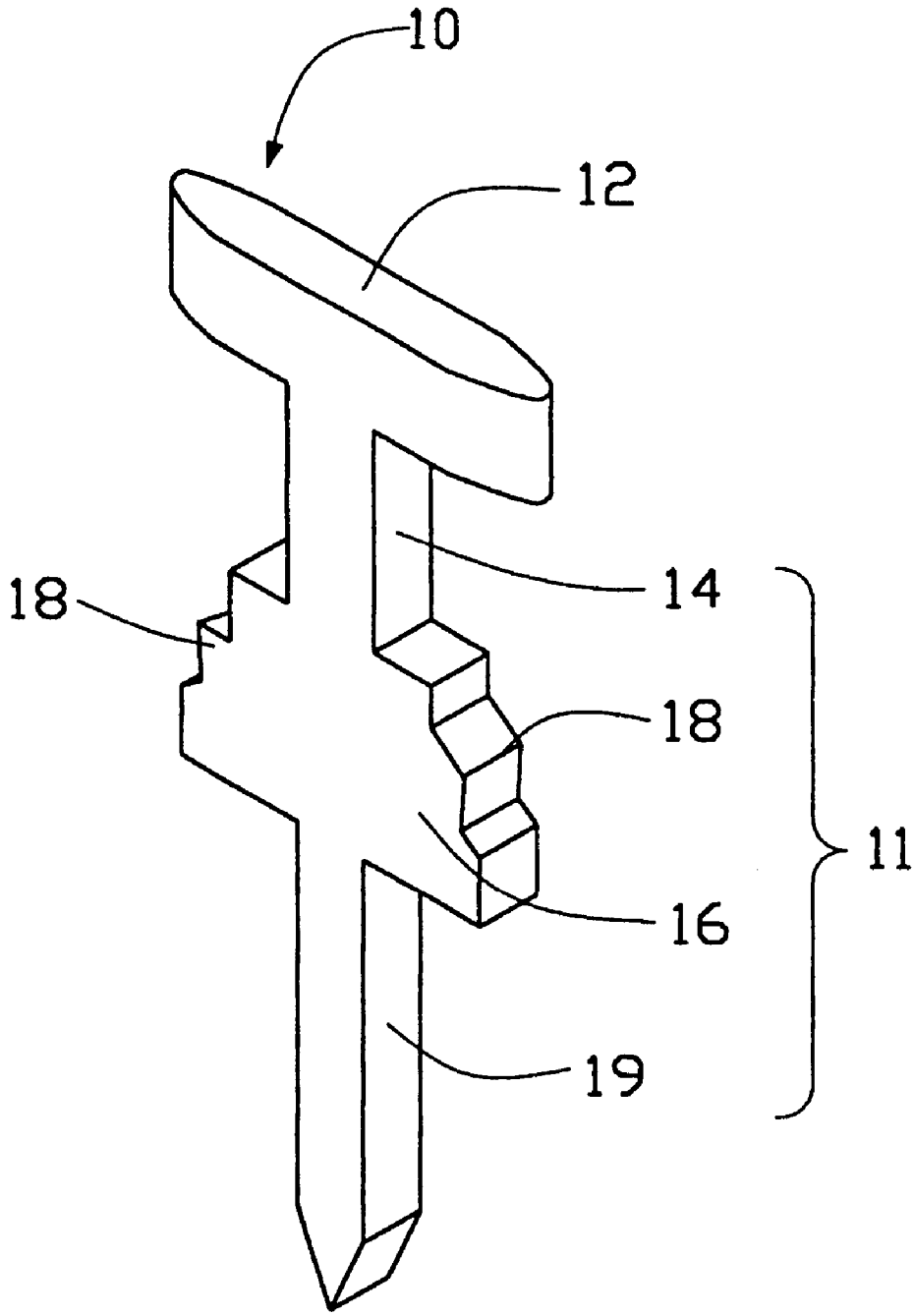
FIG. 1 is a perspective view of a contact in accordance with the present invention.
Figure 2:
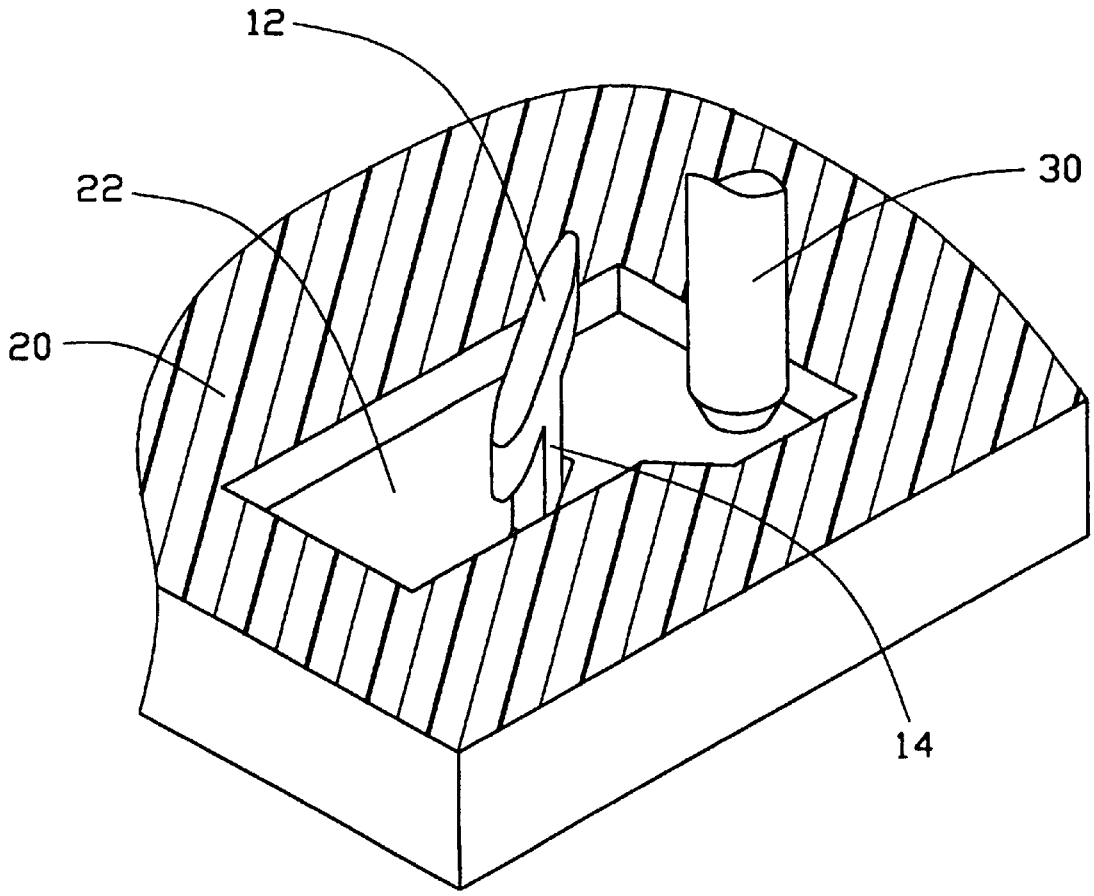
FIGS. 2–4 are perspective cut-away views of the contact of FIG. 1 fixed in a passageway of a ZIF PGA socket, and an inserted pin of a PGA device; the figures showing progressive engagement of the pin with the contact.

As illustrated in FIGS. 1 and 2, a contact 10 for a ZIF PGA socket 20 according to the present invention comprises a horizontal single-beam contact portion 12 and an elongated mounting portion 11 depending from a middle of the contact portion 12. The contact portion 12 forms arcuate faces (not labeled) at opposite sides thereof. The mounting portion 11 includes a fixing portion 16 for fixing the contact 10 to the socket 20, a leg 19 depending from the fixing portion 16, and a neck 14 integrally connecting the contact portion 12 and the fixing portion 16. The neck 14 is substantially narrower than the fixing portion 16 and the contact portion 12, thus allowing the contact portion 12 to twist about a central vertical axis of the contact 10 and to be displaced relative to the fixing portion 16. A plurality of barbs 18 is formed on opposite sides of the fixing portion 16.

Figure 3:
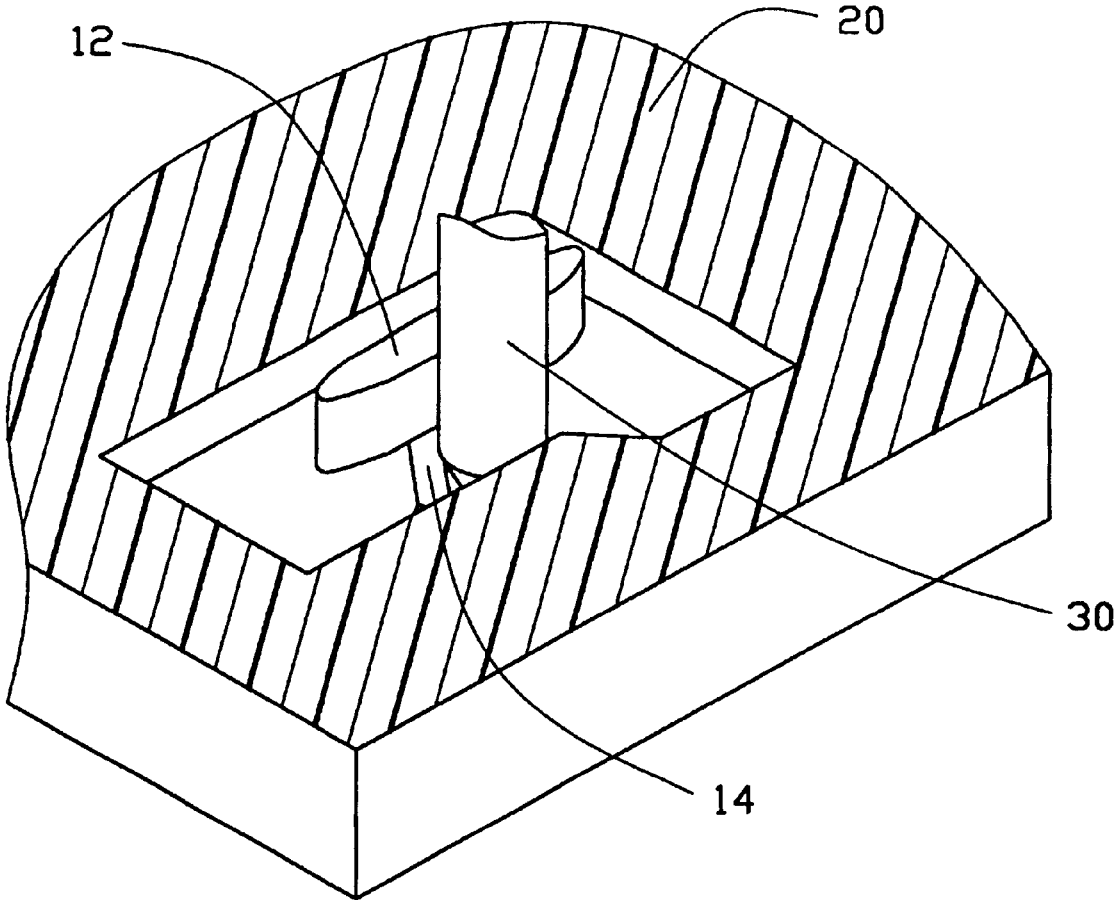
Figure 4:
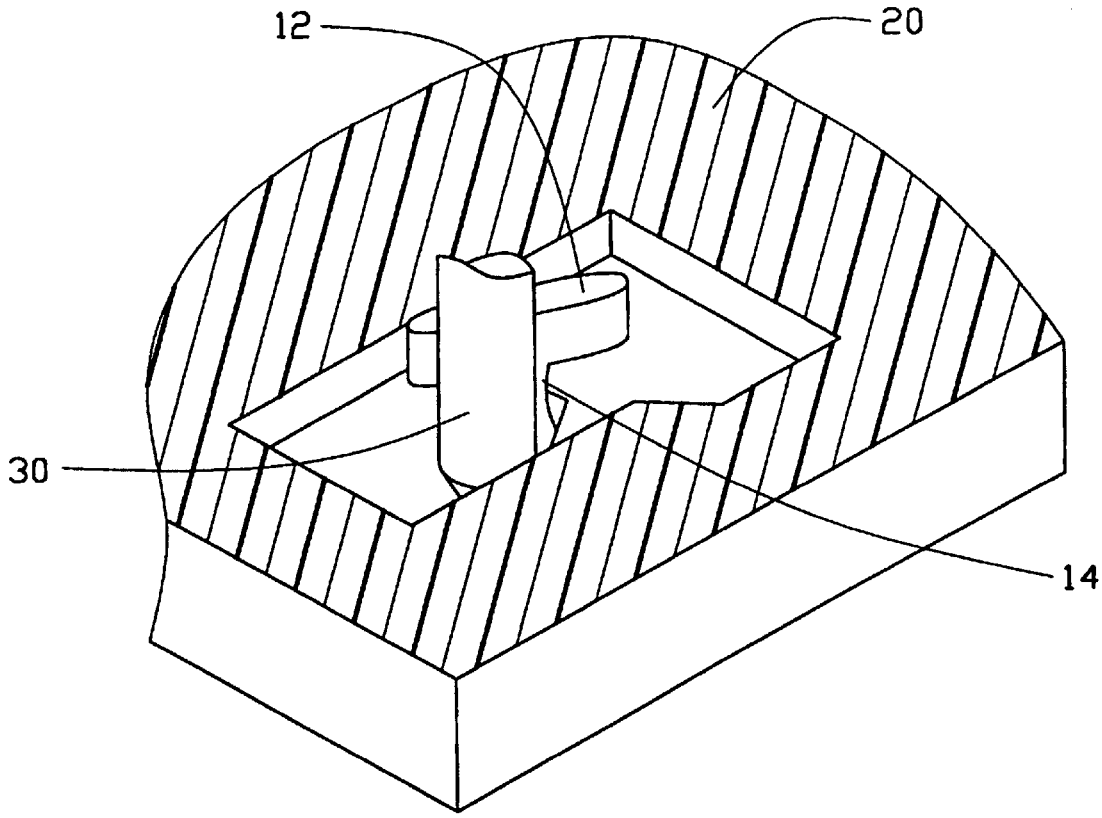

Referring to FIGS. 2 through 4, the contact 10 is received in a corresponding passageway 22 of a base of the socket 20. The leg 19 is extended downwardly through the passageway 22 to be mechanically and electrically secured to a circuit board (not shown).

Figure 5:
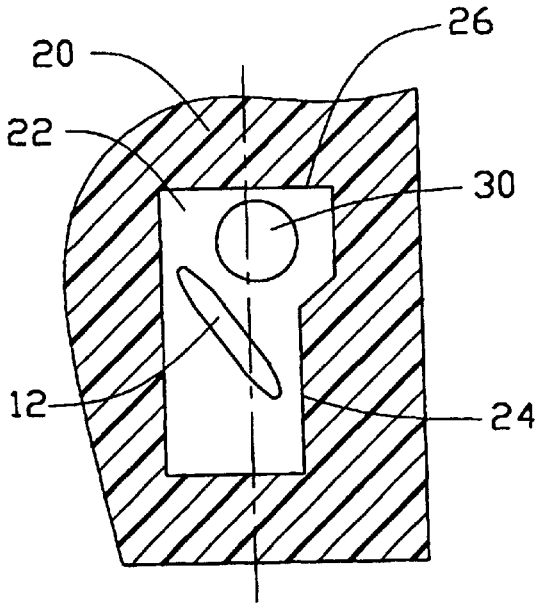
FIGS. 5–7 are schematic top planar views of FIGS. 2–4 respectively.

Referring to FIGS. 2 and 5, a recess (not labeled) is defined in a sidewall 24 of the socket 20, adjacent a rear wall 26 of the socket 20 and in communication with the passageway 22 of the socket 20. The contact portion 12 of the contact 10 is oriented at an acute angle to the sidewall 24, and far away from a junction of the sidewall 24 and the rear wall 26. Thus, a relatively large space (not labeled) is defined between the contact portion 12, the sidewall 24, and the rear wall 26. A pin 30 of a pin grid array (PGA) device (not shown) is easily inserted into the space.

Figure 6:
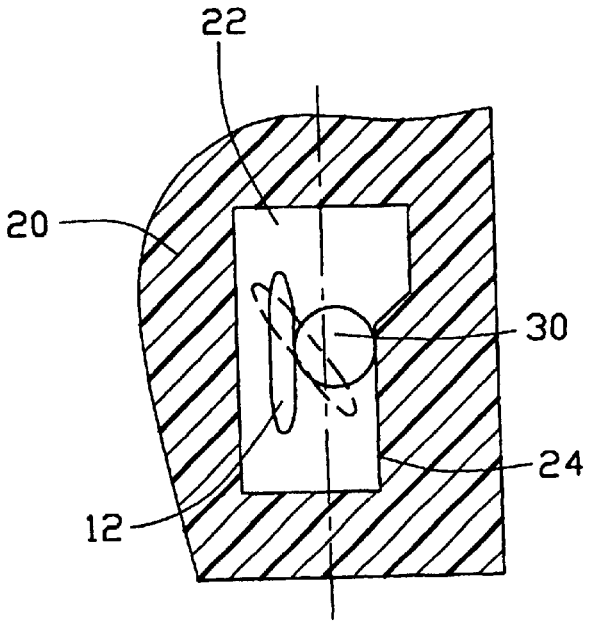

FIGS. 3 and 6 show the contact 10 engaging with the pin 30. The pin 30 is moved away from the rear wall 26 toward a middle of the passageway 22, and presses against the contact portion 12 of the contact 10. The neck 14 of the contact 10 twists, and the contact portion 12 rotates clockwise about the central vertical axis of the contact 10. The contact portion 12 is also forced away from the sidewall 24, and displaced relative to the fixing portion 16 of the contact 10. The pin 30 is continued to be moved in the same direction until the contact portion 12 has reached a position parallel to the sidewall 24. The neck 14 resiliently drives the contact portion 12 to press the pin 30 against the sidewall 24.

Figure 7:
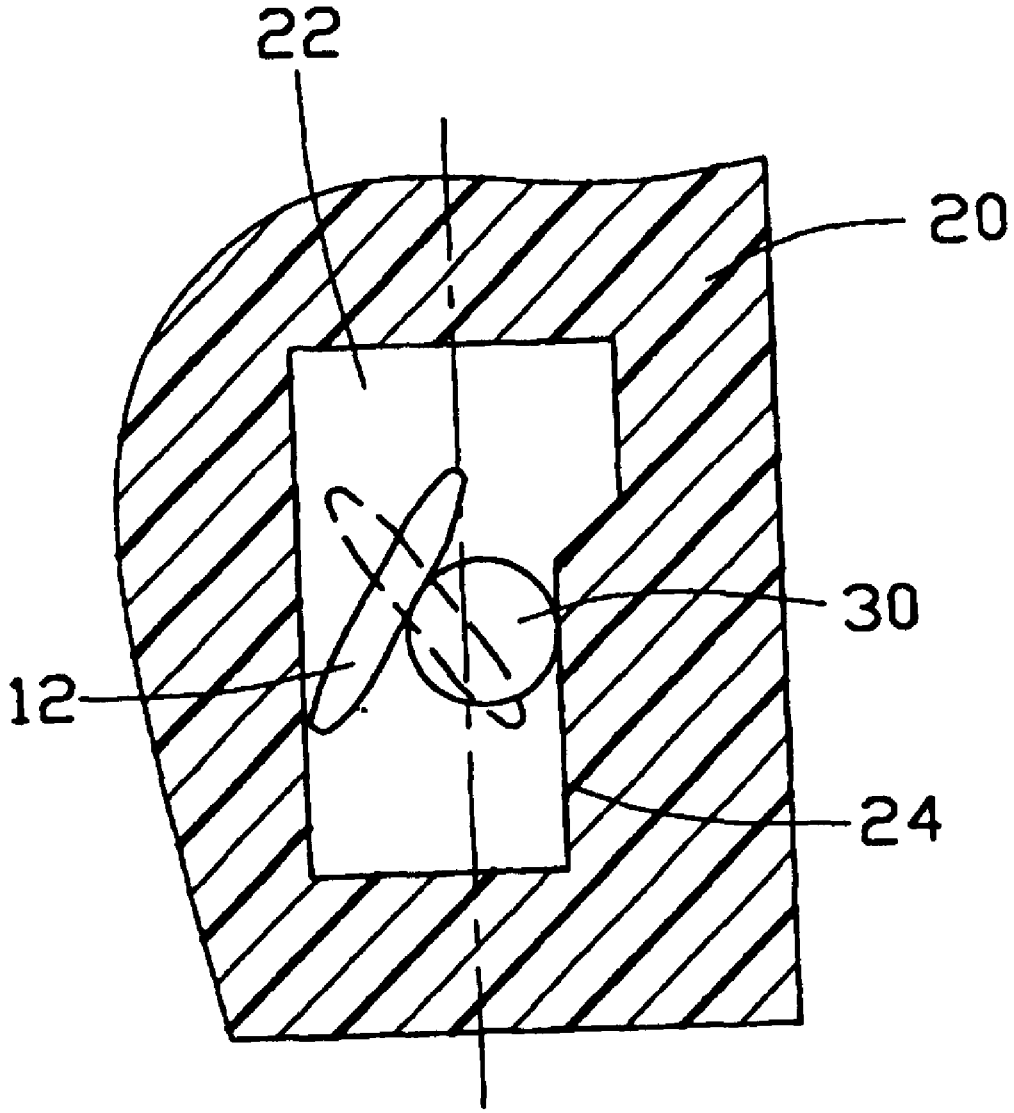

As illustrated in FIGS. 4 and 7, the pin 30 is continued to be moved in the same direction until an end of the contact portion 12 abuts a sidewall (not labeled) opposite the sidewall 24. The neck 14 has been twisted to a maximum possible extent, and resiliently urges the contact portion 12 to firmly press the pin 30 against the sidewall 24. Compared to the related art, an enhanced normal force between the pin 30 and the sidewall 24 is obtained. Thus reliable connection between the pin 30 and the contact 10 is established.

The normal force of the contact 10 on the pin 30 is made up of two components. One component is the sandwiching force applied by the contact portion 12 of the contact 10 together with the sidewall 24 of the socket 20. The other component is the resilient twisting force applied by the neck 14. Thus the total normal force is sufficient to maintain reliable connection between the contact 10 and the pin 30. Moreover, because the contact 10 is located far from the recess (not labeled) defined in the sidewall 24 of the socket 20, maximized zero insertion force (ZIF) space is made available.

What is claimed is:

1. Connector for a zero insertion force (ZIF) pin grid array (PGA) socket, the contact adapted to interconnect a PGA device and a circuit board, the contact comprising:

a horizontal single-beam contact portion forming arcuate faces at opposite sides thereof, said arcuate faces being substantially symmetric about a central vertical axis of the contact; and a mounting portion extending from the contact portion, in a vertical direction the mounting portion including a fixing portion for securing the contact to the socket, a leg depending from the fixing portion for extending through the socket to electrically communicate with the circuit board, and a neck integrally connecting the contact portion and the fixing portion, the neck being substantially narrower than the fixing portion and the contact portion and thereby being twistable when a corresponding pin of the PGA device acts upon the contact portion, thus allowing the contact portion to rotatably contact and resiliently press against the pin.

2. The contact as described in claim 1, wherein the contact portion is adapted to be oriented at an acute angle to a sidewall of the socket.

3. The contact as described in claim 1, wherein the fixing portion has a plurality of barbs on opposite sides thereof.

4. A contact for a zero insertion force (ZIF) pin grid array (PGA) socket, comprising a horizontal contact portion and a mounting portion extending from the contact portion in a vertical position, the contact portion forming arcuate faces at opposite sides thereof and the arcuate faces being substantially symmetric about a central vertical axis of the contact, the mounting portion including a fixing portion fixed to the socket, and a neck between the fixing portion and the contact portion, the neck being twistable about a central vertical axis thereof to thereby actuate resilient force on a corresponding pin of an electronic device inserted in the socket.

5. An electrical assembly comprising:

a socket forming a dielectric housing defining at least one passageway;

a contact disposed in said at least one passageway;

said contact including a mounting portion retained in the housing in a vertical direction and a planar contact portion positioned on a top end of the contact in a horizontal direction, said mounting portion includes a fixing portion, a leg extending from the fixing portion toward a bottom end of the contact and a neck portion integrally connecting the planar contact portion and the fixing portion; and a pin of an electronic device horizontally moved along a direction in said at least one passageway, said planar contact portion being oriented at an acute angle relative to said direction in said at least one passageway; wherein said pin is moved from a first position with a zero insertion force and to a second position to engage the planar contact portion, where said contact imposes forces on the pin due to both torsion and deflection of the neck portion of said mounting portion.

6. The assembly as described in claim 5, wherein said contact portion horizontally extends on two sides of said mounting portion.

* * * * *